US010525313B2

(12) United States Patent
Greer

(10) Patent No.: US 10,525,313 B2
(45) **Date of Patent: *Jan. 7, 2020**

(54) VARIABLE BOUNCE HEIGHT CLUB HEADS AND RELATED METHODS

(71) Applicant: Karsten Manufacturing Corporation, Phoenix, AZ (US)

(72) Inventor: Evan Greer, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/172,548

(22) Filed: Oct. 26, 2018

(65) Prior Publication Data

US 2019/0060723 A1 Feb. 28, 2019

Related U.S. Application Data

(63) Continuation of application No. 15/070,331, filed on Mar. 15, 2016, now Pat. No. 10,137,341, which is a continuation-in-part of application No. 13/870,817, filed on Apr. 25, 2013, now abandoned.

(60) Provisional application No. 61/780,217, filed on Mar. 13, 2013.

(51) Int. Cl.

| | |
|---|---|
| ***A63B 53/00*** | (2015.01) |
| ***A63B 55/00*** | (2015.01) |
| ***A63B 53/06*** | (2015.01) |
| ***A63B 53/04*** | (2015.01) |
| ***A63B 60/54*** | (2015.01) |
| ***A63B 60/42*** | (2015.01) |

(52) U.S. Cl.

CPC ..... *A63B 53/06* (2013.01); *A63B 53/047* (2013.01); *A63B 60/42* (2015.10); *A63B 60/54* (2015.10); *A63B 2053/0433* (2013.01); *A63B 2053/0491* (2013.01)

(58) Field of Classification Search

CPC ..... A63B 53/06; A63B 2053/0433; A63B 53/047; A63B 53/0475; A63B 2053/0491

See application file for complete search history.

(56) References Cited

U.S. PATENT DOCUMENTS

| | | | | |
|---|---|---|---|---|
| 2,328,583 A | | 9/1943 | Reach | |
| 2,332,342 A | | 10/1943 | Reach | |
| 4,222,567 A | * | 9/1980 | Shabala | A63B 53/04 473/242 |
| 4,540,178 A | * | 9/1985 | Johnson | A63B 53/06 473/335 |
| 4,708,347 A | | 11/1987 | Kobayashi | |
| 5,228,689 A | * | 7/1993 | Donofrio, Sr. | A63B 53/06 473/245 |
| 5,386,996 A | | 2/1995 | Hiruta | |
| 5,435,551 A | | 7/1995 | Chen | |
| 5,439,223 A | | 8/1995 | Kobayashi | |
| 5,807,186 A | * | 9/1998 | Chen | A63B 53/04 473/248 |
| 5,833,551 A | | 11/1998 | Vincent | |

(Continued)

*Primary Examiner* — Eugene L Kim
*Assistant Examiner* — Matthew B Stanczak

(57) ABSTRACT

A golf club head comprising a club head body removably coupled at different times with various attachment members in a recess of the club head body. In some embodiments, the golf club head comprises different characteristics when coupled with different attachment members. In some embodiments, different attachment members alter characteristics, such as bounce height, while maintaining other characteristics, such as loft angle and/or bounce angle.

20 Claims, 11 Drawing Sheets

(56) References Cited

U.S. PATENT DOCUMENTS 5,916,042 A * 6/1999 Reimers ..... A63B 53/04 473/334
5,938,540 A * 8/1999 Lu ..... A63B 53/04 473/288
6,471,601 B1 10/2002 McCabe
6,569,029 B1 * 5/2003 Hamburger ..... A63B 53/047 473/238
7,125,341 B1 * 10/2006 D'Eath ..... A63B 53/0487 473/251
7,140,976 B2 * 11/2006 Chen ..... A63B 53/047 473/334
8,083,607 B2 * 12/2011 Clausen ..... A63B 53/047 473/291
8,133,129 B2 3/2012 Boyd et al.
8,491,405 B2 * 7/2013 Jorgensen ..... A63B 53/047 473/288
8,777,774 B1 * 7/2014 Kim ..... A63B 53/047 473/336
8,821,307 B2 * 9/2014 Park ..... A63B 53/04 473/244
8,911,302 B1 * 12/2014 Ivanova ..... A63B 53/0475 473/329
8,915,797 B1 * 12/2014 Kuhar ..... A63B 53/047 473/324
9,033,813 B2 * 5/2015 Oldknow ..... A63B 53/0466 473/244
9,033,814 B2 5/2015 Stites
9,662,550 B2 * 5/2017 Oldknow ..... A63B 53/0466
9,669,272 B2 * 6/2017 Park ..... A63B 53/04
9,700,767 B2 * 7/2017 Zimmerman ..... A63B 53/04
9,713,751 B2 * 7/2017 Hettinger ..... A63B 53/047
10,137,341 B2 * 11/2018 Greer ..... A63B 60/42
2004/0214654 A1 10/2004 Pelz
2009/0291772 A1 * 11/2009 Boyd ..... A63B 53/047 473/291
2011/0256953 A1 * 10/2011 Jorgensen ..... A63B 53/047 473/324
2012/0064997 A1 * 3/2012 Sato ..... A63B 53/047 473/350
2012/0231897 A1 * 9/2012 Hettinger ..... A63B 53/02 473/349
2012/0238375 A1 * 9/2012 Park ..... A63B 53/04 473/331
2013/0109497 A1 * 5/2013 Ban ..... A63B 53/047 473/330
2013/0165251 A1 * 6/2013 Jorgensen ..... A63B 53/06 473/328
2013/0324276 A1 * 12/2013 Stites ..... A63B 53/047 473/244
2014/0274441 A1 * 9/2014 Greer ..... A63B 53/047 473/290
2015/0005099 A1 * 1/2015 Hettinger ..... A63B 53/047 473/350
2015/0231457 A1 * 8/2015 Sander ..... A63B 53/047 473/244
2016/0193511 A1 * 7/2016 Greer ..... A63B 60/42 473/290
2017/0095707 A1 * 4/2017 Ripp ..... A63B 53/047

* cited by examiner

VARIABLE BOUNCE HEIGHT CLUB HEADS AND RELATED METHODS

CROSS-REFERENCE TO RELATED APPLICATIONS

This is a continuation of U.S. Non-Provisional patent application Ser. No. 15/070,331, filed on Mar. 15, 2016, which is a continuation-in-part of U.S. Non-Provisional patent application Ser. No. 13/870,817, filed on Apr. 25, 2013, which claims the benefit of U.S. Provisional Application No. 61/780,217, filed on Mar. 13, 2013, all of which are fully incorporated herein by reference.

TECHNICAL FIELD

This disclosure relates generally to sports equipment, and relates more particularly to club heads and related methods.

BACKGROUND

The bounce angle of a golf club can impact the flight distance and/or accuracy of the golf ball, but the bounce height (i.e., the rise in the bounce angle) can have an even greater impact on the flight distance and/or accuracy of the golf ball. Specifically, the bounce angle and/or bounce height can determine how easily a golf club head can penetrate the ground under the golf ball during a golf club swing. However, ground conditions are subject to change such that the ground may be harder or softer at certain times due to weather, grooming, etc. Accordingly, a club head with a particular bounce angle and/or bounce height configuration may be better in certain circumstances than in other circumstances.

BRIEF DESCRIPTION OF THE DRAWINGS

To facilitate further description of the embodiments, the following drawings are provided in which.

Figure 1:
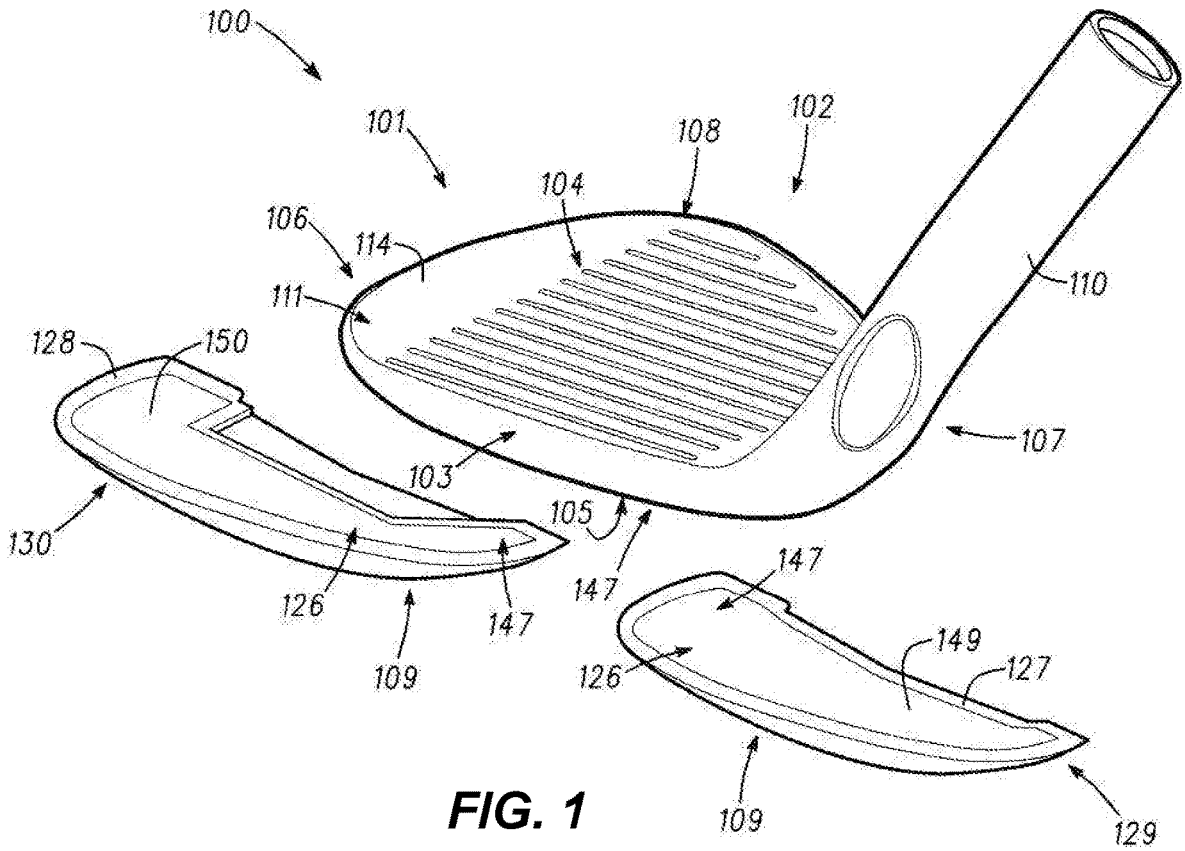
FIG. 1 illustrates a top, front, heel side view of a first club head body of a first club head next to two or more first club head attachment members of the first club head, according to an embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

DESCRIPTION

Some embodiments include a golf club head. The golf club head can comprise a club head body configured to be removably coupled at different times with a first attachment member and a second attachment member. When the club head body is coupled with the first attachment member, the golf club head comprises a loft angle, a bounce angle, and a first bounce height. Further, when the club head body is coupled with the second attachment member, the golf club head comprises the loft angle, the bounce angle, and a second bounce height different than the first bounce height.

Many embodiments include a set of golf club heads. The set of golf club heads can comprise a first club head and a second club head. The first club head can comprise a first club head body configured to be removably coupled at different times with a first attachment member and a second attachment member. Meanwhile, the second club head can comprise a second club head body configured to be removably coupled at different times with a third attachment member and a fourth attachment member. When the first club head body is coupled with the first attachment member, the first club head comprises a first loft angle, a first bounce angle, and a first bounce height; and when the first club head body is coupled with the second attachment member, the first club head comprises the first loft angle, the first bounce angle, and a second bounce height different than the first bounce height. Further, when the second club head body is coupled with the third attachment member, the second club head comprises a second loft angle, a second bounce angle, and a third bounce height; and when the second club head body is coupled with the fourth attachment member, the second club head comprises the second loft angle, the second bounce angle, and a fourth bounce height different than the third bounce height.

Other embodiments include one or more golf club heads. The golf club head(s) comprise a first club head comprising a first club head body configured to be removably coupled at different times with a first club head first attachment member and a first club head second attachment member. When the first club head body is coupled with the first club head first attachment member, the first club head comprises a first loft angle, a first bounce angle, and a first bounce height. Further, when the first club head body is coupled with the first club head second attachment member, the first club head comprises the first loft angle, the first bounce angle, and a second bounce height different than the first bounce height.

In these embodiments, the golf club head(s) can also comprise a second club head. The second club head comprises a second club head body configured to be removably coupled at different times with a second club head first attachment member and a second club head second attachment member. When the second club head body is coupled with the second club head first attachment member, the second club head comprises a second loft angle, a second bounce angle, and a third bounce height. Further, when the second club head body is coupled with the second club head second attachment member, the second club head comprises the second loft angle, the second bounce angle, and a fourth bounce height different than the third bounce height.

In these or other embodiments, at least one of (i) the second loft angle can be greater than the first loft angle, (ii) the second bounce height can be greater than the first bounce height, and the third bounce height can be greater than or approximately equal to the first bounce height, or (iii) the fourth bounce height can be greater than the third bounce height, and the fourth bounce height can be greater than or approximately equal to the second bounce height.

Further embodiments include multiple attachment members. The multiple attachment members can comprise a first attachment member and a second attachment member, each being configured to be removably coupled at different times with a first club head body of a first golf club head. When the first attachment member is coupled with the first club head body, the first golf club head comprises a first loft angle, a first bounce angle, a first bounce height, and a first sole width. Further, when the second attachment member is coupled with the first club head body, the first golf club head comprises the first loft angle, the first bounce angle, a second bounce height different than the first bounce height, and a second sole width different than the first sole width.

Some embodiments include a method comprising: providing a first attachment member; and providing a second attachment member. The first attachment member and the second attachment member are each configured to be removably coupled at different times with a club head body of a golf club head. When the first attachment member is coupled with the club head body, the golf club head comprises a loft angle, a bounce angle, a first bounce height, and a first sole width. Further, when the second attachment member is coupled with the club head body, the golf club head comprises the loft angle, the bounce angle, a second bounce height different than the first bounce height, and a second sole width different than the first sole width.

Other embodiments include a method comprising: providing a first club head first attachment member; and providing a first club head second attachment member. The first club head first attachment member and the first club head second attachment member are each configured to be removably coupled at different times with a first club head body of a first golf club head. When the first club head first attachment member is coupled with the first club head body, the first golf club head comprises a first loft angle, a first bounce angle, a first bounce height, and a first sole width. Further, when the first club head second attachment member is coupled with the first club head body, the first golf club head comprises the first loft angle, the first bounce angle, a second bounce height different than the first bounce height, and a second sole width different than the first sole width.

In these embodiments, the method can further comprise: providing a second club head first attachment member; and providing a second club head second attachment member. The second club head first attachment member and the second club head second attachment member are each configured to be removably coupled at different times with a second club head body of a second golf club head. When the second club head first attachment member is coupled with the second club head body, the second golf club head comprises a second loft angle, a second bounce angle, a third bounce height, and a third sole width. Further, when the second club head second attachment member is coupled with the second club head body, the second golf club head comprises the second loft angle, the second bounce angle, a fourth bounce height different than the third bounce height, and a fourth sole width different than the third sole width.

Figure 2:
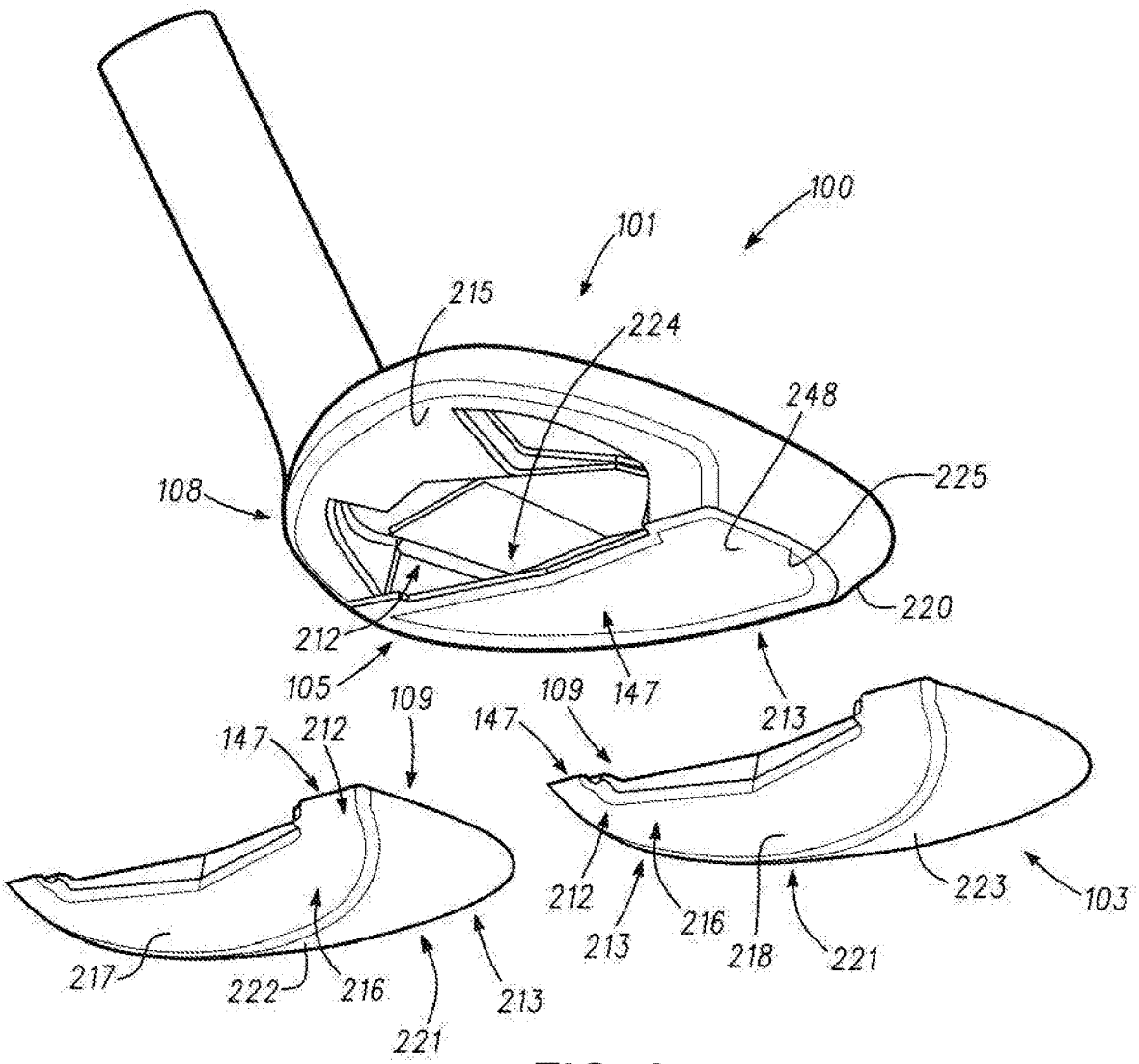
FIG. 2 illustrates a bottom, rear, toe side view of the first club head body of FIG. 1 next to the two or more first club head attachment members of FIG. 1, according to the embodiment of FIG. 1.

Turning to the drawings, FIG. 1 illustrates a top, front, heel side view of a first club head body 108 of a first club head 101 of one or more club heads 100 next to two or more first club head attachment members 109 of first club head 101, according to an embodiment. Meanwhile, FIG. 2 illustrates a bottom, rear, toe side view of first club head body 108 of first club head 101 of club head(s) 100 next to first club head attachment members 109, according to the embodiment of FIG. 1. Club head(s) 100 is merely exemplary and is not limited to the embodiments presented herein. Club head(s) 100 can be employed in many different embodiments or examples not specifically depicted or described herein.

Generally, club head(s) 100 can comprise one or more golf club heads. Each of the golf club head(s) can be part of a corresponding golf club. Further, the golf club head(s) can be part or all of a set of golf club heads and/or the golf club(s) can be part or all of a set of golf clubs. Although club head(s) 100 can comprise any suitable type of golf club head, in many examples, club head(s) 100 comprises one or more iron-type golf club heads. Further, the iron-type golf club head(s) can comprise a muscle-back or cavity-back configuration. The apparatus, methods, and articles of manufactured described herein are not limited in this regard.

Referring to FIG. 1, club head(s) 100 comprises first club head 101. As discussed in further detail herein, club head(s) 100 can also comprise one or more additional club heads (e.g., a second club head 501 (FIGS. 5-7)). When club head(s) 100 comprise the additional club heads, each of club head(s) 100 (and the corresponding constituent elements thereof) can be similar to each other.

First club head 101 comprises a top end 102, a bottom end 103, a front end 104, a rear end 105, a toe end 106, and a heel end 107. Further, first club head 101 can comprise a first club head body 108 and/or two or more first club head attachment members 109 (e.g., a first club head first attachment member 129, a first club head second attachment member 130, etc.). In some examples, first club head attachment members 109 can comprise any suitable number of first club head attachment members (e.g., three first club head attachment members, four first club head attachment members, five first club head attachment members, six first club head attachment members, etc.). In some embodiments, club head 100 can comprise hosel 110, which in other embodiments can be omitted. Although, in some embodiments, each of first club head attachment members 109 can be implemented as multiple elements, for ease and clarity of illustration, each of first club head attachment members 109 is discussed as being a single element.

Meanwhile, first club head 101 can comprise a front surface 111, a rear surface 212 (FIG. 2), a sole surface 213 (FIG. 2), and/or a custom tuning port (CTP) 224 (FIG. 2). Further, first club head body 108 can comprise a first club head body interface 225 (FIG. 2), and each of first club head attachment members 109 can comprise a corresponding one of first club head attachment member interfaces 126 (e.g., a first club head first attachment member interface 127, a first club head second attachment member interface 128, etc.). As applicable, (a) front surface 111 can comprise (i) a body front surface 114 and/or (ii) one of first club head attachment member front surfaces (not shown); (b) rear surface 212 (FIG. 2) can comprise (i) a body rear surface 215 (FIG. 2) and/or (ii) one of first club head attachment member rear surfaces 216 (e.g., a first club head first attachment member rear surface 217 (FIG. 2), a first club head second attachment member rear surface 218 (FIG. 2), etc.); and (c) sole surface 213 (FIG. 2) can comprise (i) a body sole surface 220 (FIG. 2) and/or (ii) one of first club head attachment member sole surface(s) 221 (e.g., a first club head first attachment member sole surface 222 (FIG. 2), a first club head second attachment member sole surface 223 (FIG. 2), etc.). However, in some embodiments, the first club attachment member front surfaces, body rear surface 215 (FIG. 2), and/or body sole surface 220 (FIG. 2) can be omitted.

For example, part of front surface 111 (e.g., body front surface 114) can be part of first club head body 108, and part of front surface 111 (e.g., an applicable one of the first club head attachment member front surfaces) can be part of an applicable one of first club head attachment members 109. Nonetheless, in other examples, body front surface 114 can comprise front surface 111, and the first club head attachment member front surfaces can be omitted. In these examples, body front surface 114 can form all of front surface 111.

Further, part of rear surface 212 (e.g., body rear surface 215 (FIG. 2)) can be part of first club head body 108, and part of rear surface 212 (e.g., an applicable one of first club head attachment member rear surfaces 216 (FIG. 2)) can be part of an applicable one of first club head attachment members 109. Nonetheless, in other examples, the applicable one of first club head attachment member rear surfaces 216 (FIG. 2) can comprise rear surface 212 (FIG. 2), and body rear surface 215 (FIG. 2) can be omitted. In these examples, the applicable one of first club head attachment member rear surfaces 216 (FIG. 2) can form all of rear surface 212 (FIG. 2).

Further still, part of sole surface 213 (e.g., body sole surface 220 (FIG. 2)) can be part of first club head body 108, and part of sole surface 213 (e.g., an applicable one of first club head attachment member sole surfaces 221 (FIG. 2)) can be part of an applicable one of first club head attachment members 109. Nonetheless, in other examples, the applicable one of first club head attachment member rear surfaces 221 (FIG. 2) can comprise sole surface 213 (FIG. 2), and body sole surface 220 (FIG. 2) can be omitted. In these examples, the applicable one of first club head attachment member rear surfaces 221 (FIG. 2) can form all of sole surface 213 (FIG. 2).

Meanwhile, rear surface 212 (FIG. 2), body rear surface 215 (FIG. 2), and/or an applicable one of first club head attachment member rear surfaces 216 (FIG. 2) can comprise and/or form CTP 224 (FIG. 2). In other embodiments, CTP 224 (FIG. 2) can be omitted.

Top end 102 is opposite bottom end 103; front end 104 is opposite rear end 105; and toe end 106 is opposite heel end 107. Front surface 111 can be located at front end 104; rear surface 212 (FIG. 2) can be located at rear end 105 and/or opposite of front surface 111; and sole surface 213 (FIG. 2) can be located at bottom end 103.

First club head body 108 is configured to be coupled (e.g., removably, seamlessly, and/or at different times) with each of first club head attachment members 109. For example, first club head body 108 can be coupled with first club head attachment members 109 at first club head body interface 225 (FIG. 2) and first club head attachment member interfaces 126 (e.g., first club head first attachment member interface 127, first club head second attachment member interface 128, etc.).

First club head body 108 and first club head attachment members 109 can be coupled together by any suitable coupling mechanism(s) (e.g., a fastener, a joint, and/or an adhesive, etc.). An exemplary fastener can comprise a screw, a nut and bolt, etc. An exemplary joint can comprise a mortise and tenon joint, a dovetail joint, etc. Further, where multiple coupling mechanisms are implemented, the coupling mechanisms can be the same or different from each other. The apparatus, methods, and articles of manufactured described herein are not limited in this regard.

Further, first club head 101 can comprise an alignment aid. The alignment aid can comprise any pair of a body alignment aid and one of two or more attachment member alignment aids. The alignment aid, the body alignment aid, and/or the attachment member alignment aid(s) can be configured to facilitate coupling together first club head body 108 and first club head attachment members 109. For example, the alignment aid, the body alignment aid, and/or the attachment member alignment aid(s) can operate as a guide for coupling together first club head body 108 and first club head attachment members 109. In many examples, first club head body 108 can comprise the body alignment aid, and/or each of first club head attachment members 109 can comprise one of the attachment member alignment aids. In other examples, the alignment aid can be omitted. In some embodiments, one or more of the coupling mechanism(s) implemented to couple together first club head body 108 and first club head attachment members 109 can comprise the alignment aid. That is, one or more of the coupling mechanism(s) can also facilitate coupling together first club head body 108 and first club head attachment members 109, and/or the alignment aid can also couple together first club head body 108 and first club head attachment members 109.

When the alignment aid is implemented, the alignment aid can comprise any suitable mechanism(s) to facilitate coupling together first club head body 108 and first club head attachment members 109. In some examples, the alignment aid can comprise one or more markings (e.g., arrows, etc.). In these examples, the body alignment aid can comprise a marking, and/or the attachment member alignment aid(s) can each comprise a marking. The markings can be complimentary with each other. In these or other examples, the alignment aid can comprise one or more joints. In these examples, the body alignment aid can comprise one or more first joint features, and/or the attachment member alignment aid(s) can each comprise one or more second joint features complimentary to the first joint features. Each of the first joint features can be the same or different from each other, and each of the second joint features can be the same or different from each other. In other examples, the alignment aid can comprise one or more fasteners and/or fastener receptacles configured to receive the fasteners.

Figure 3:
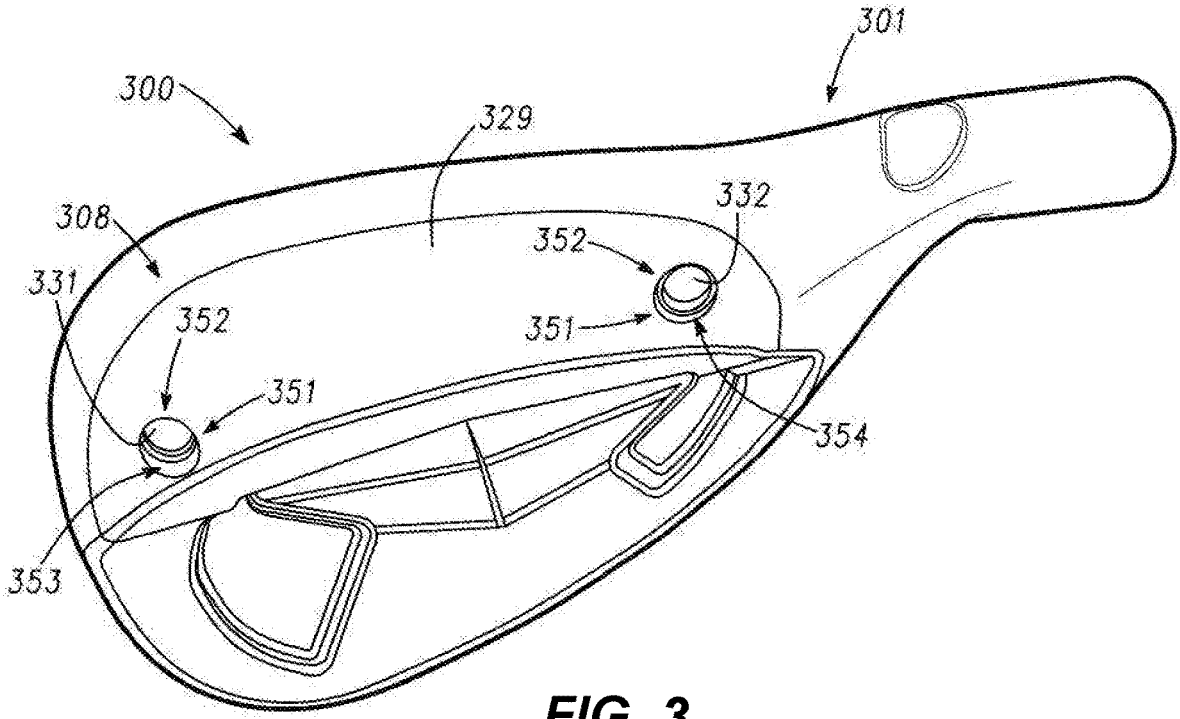
FIG. 3 shows a bottom side view of a club head body of a club head coupled to an exemplary club head attachment member, according to an embodiment.

Turning ahead briefly in the drawings for illustration, FIG. 3 shows a bottom side view of club head body 308 of club head 301 of club head(s) 300 coupled to club head attachment member 329, according to an embodiment. Club head(s) 300 can be similar or identical to club head(s) 100 (FIG. 1), and club head 301 can be similar or identical to first club head 101 (FIG. 1). Further, club head body 308 can be similar or identical to first club head body 108 (FIG. 1), and/or club head attachment member 329 can be similar or identical to first club head first attachment member 129 (FIG. 1). Club head body 308 and club head attachment member 329 can be coupled together by first coupling mechanism 331 and by second coupling mechanism 332. Coupling mechanisms 331 and 332 can comprise screw-type fasteners. Further, club head 301 can comprise alignment aid 351. The body alignment aid (blocked from view by club head attachment member 329) of alignment aid 351 and attachment member alignment aid 352 (e.g., first coupling mechanism receptacle 353 corresponding to first coupling mechanism 331, and/or second coupling mechanism receptacle 354 corresponding to second coupling mechanism 332) of alignment aid 351 can help align club head body 308 with club head attachment members 329.

Referring now back to FIG. 1, in some embodiments, first club head 101 can comprise one or more optional dampening members 147. Dampening member(s) 147 can dampen vibrations between first club head body 108 and first club head attachment members 109, such as, for example, when first club head body 108 and any one of first club head attachment members 109 are coupled together. In some embodiments, first club head body 108 can comprise dampening member 248 (FIG. 2), such as, for example, at first club head body interface 125. In these or other embodiments, first club head attachment members 109 can each comprise a dampening member, such as, for example, at each of first club head attachment member interfaces 126 (e.g., dampening member 149 at first club head attachment member interface 127, dampening member 150 at first club head attachment member interface 128. In other embodiments, one or more of dampening member(s) 147 can be separate from first club head body 108 and first club head attachment members 109. Accordingly, although FIGS. 1 & 2 illustrate dampening member(s) 147 as being part of first club head body 108 and first club head attachment members 109, in other embodiments, one or more of dampening member(s) 147 (e.g., dampening member 248 (FIG. 2), dampening member 149, and/or dampening member 150) can be separate from first club head body 108 and/or first club head attachment members 109, as applicable. In still other embodiments, one or more of dampening member(s) 147 (e.g., dampening member 248 (FIG. 2), dampening member 149, and/or dampening member 150) can be omitted. Dampening member(s) 147 can comprise any suitable material(s) (e.g., an elastomeric or elastic material, such as, for example, rubber, etc.) configured to dampen vibrations.

Front surface 111 can refer to a strike face and/or strike plate of first club head 101, and can be configured to impact a golf ball (not shown). Front surface 111 can be substantially planar, and/or can comprise one or more scoring lines (e.g., grooves). The scoring line(s) can extend between toe end 106 and heel end 107. When front surface 111 comprises multiple scoring lines, the scoring lines can be parallel to each other.

Hosel 110 can be located at or proximate to heel end 107, and hosel 110 can extend from first club head 101 via a hosel transition portion. Hosel 110 can be configured to receive a shaft (not shown). In a different embodiment, club head 100 can comprise a bore (not shown) configured to receive the shaft. When hosel 110 (or the bore) receives the shaft, first club head 101 and the shaft can substantially provide a golf club, as described above.

Figure 4:
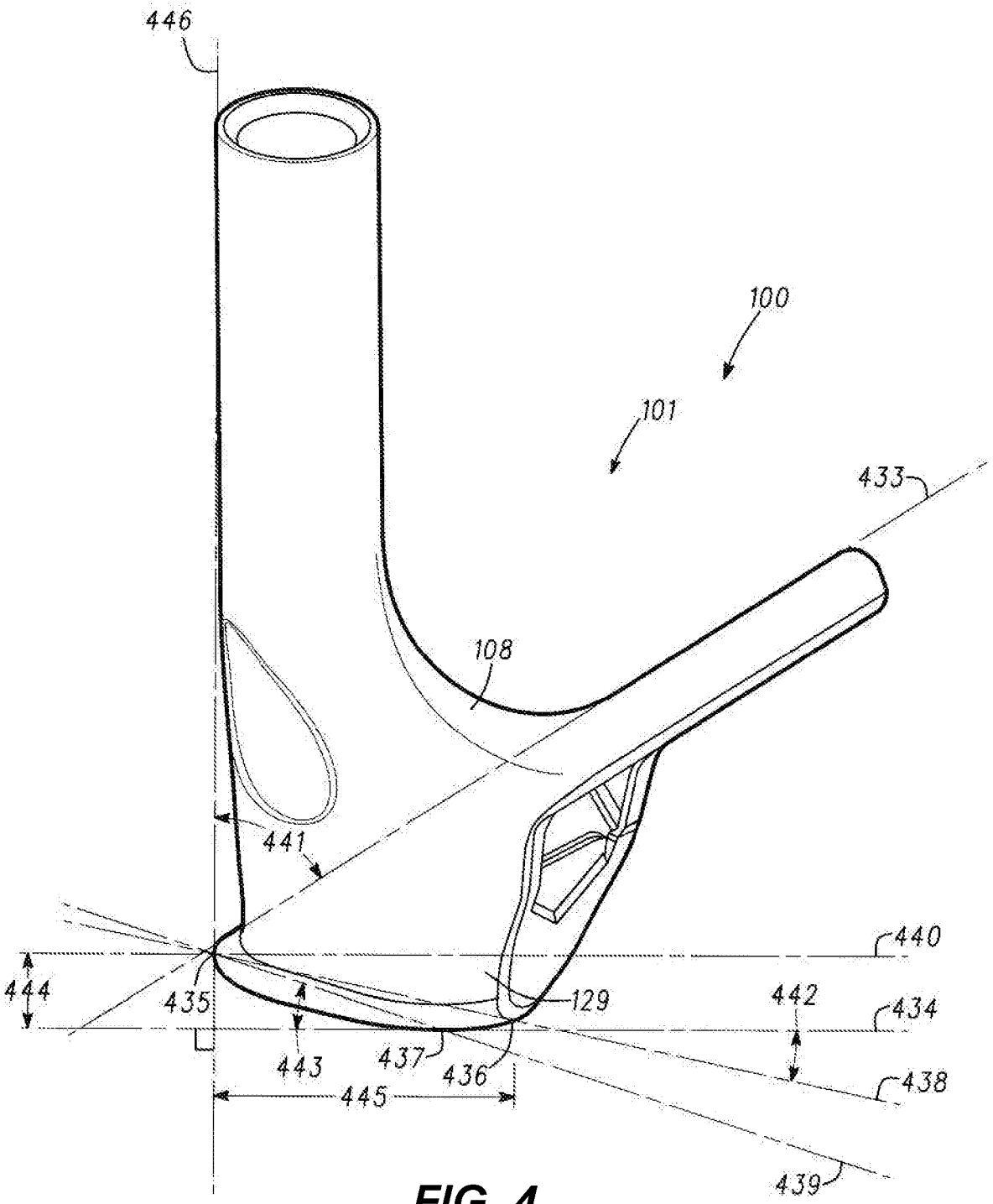
FIG. 4 illustrates a heel side view of the first club head of FIG. 1 when the first club head body is coupled to one of the first club head attachment members of the two or more first club head attachment members, according to the embodiment of FIGS. 1 & 2.

Skipping ahead in the drawings, FIG. 4 illustrates a heel side view of first club head 101 when first club head body 108 is coupled to first club head attachment member 129, according to the embodiment of FIGS. 1 & 2.

First club head 101 comprises loft plane 433 and ground plane 434. Further, first club head 101 can also comprise leading edge 435, trailing edge 436, ground contact 437, edge line 438, contact line 439, and/or height plane 440. Loft plane 433, ground plane 434, edge plane 438, contact plane 439, and height plane 440 can refer to reference planes of first club head 101, and leading edge 435, trailing edge 436, and ground contact 437 can refer to reference points of first club head 101. Meanwhile, first club head 101 further comprises loft angle 441, effective bounce angle 442, traditional bounce angle 443, bounce height 444, and sole width 445.

Loft plane 433 intersects the foremost point or points (e.g., nearest front end 104 (FIGS. 1 & 2)) of front surface 111 (FIG. 1). In some examples, the foremost point can be leading edge 435. Further, loft plane 433 can be approximately parallel with front surface 111 (FIG. 1) when first club head 101 is positioned both to address a golf ball and in a resting state. When front surface 111 (FIG. 1) is planar and/or substantially planar, front surface 111 and loft plane 433 can be approximately co-planar. Meanwhile, when front surface 111 (FIG. 1) is curved (e.g., non-planar), as can frequently be implemented with wood-type club heads, loft plane 433 can refer to a reference plane intersecting an inflection point in the curvature of front surface 111. Accordingly, in these embodiments, at least part of front surface 111 (FIG. 1) can be located behind loft plane 433.

Leading edge 435 can refer to a foremost point of sole surface 213 (FIG. 2) when first club head 101 is positioned both to address a golf ball and in a resting state; trailing edge 436 can refer to a rearmost point of sole surface 213 (FIG. 2) when first club head 101 is positioned both to address a golf ball and in a resting state; and ground contact 437 can refer to a lowest point of sole surface 213 (FIG. 2) when first club head 101 is positioned both to address a golf ball and in a resting state.

Ground plane 434 refers to the plane generally formed by the ground below club head 101 when first club head 101 is positioned to address a golf ball. Ground plane 434 can intersect ground contact 437 when first club head 101 is positioned to address a golf ball. Meanwhile, edge line 438 refers to the line intersecting leading edge 435 and trailing edge 436; and contact line 439 refers to the line intersecting leading edge 435 and ground contact 437. Further, height plane 440 refers to a plane approximately parallel to ground plane 434 and intersecting leading edge 435.

Bounce height 444 can refer to a distance between ground plane 434 and height plane 440. Meanwhile, sole width 445 can refer to a distance between leading edge 435 and trailing edge 436.

Loft angle 441 can refer to an angle formed between loft plane 433 and normal line 446, which refers to a reference line orthogonal to ground plane 434 and intersecting leading edge 435 when first club head 101 is positioned to address a golf ball. Effective bounce angle 442 can refer to an angle formed between edge line 438 and ground plane 434, and traditional bounce angle 443 can refer to an angle formed between contact line 439 and ground plane 434.

First club head 101 can be configured such that loft angle 441, effective bounce angle 442, and/or traditional bounce angle 443 remain constant for first club head 101 while bounce height 444 and/or sole width 445 can be varied for first club head 101 as first club head body 108 is coupled with different ones of first club head attachment members 109. As a result, bounce height 444 and/or sole width 445 can be tailored as desired for first club head 101. That is, first club head 101 can be adjustable so that coupling different ones of first club head attachment members 109 to first club head body 108 can provide differing configurations of bounce height 444 and/or sole width 445. Further, when effective bounce angle 442 and/or traditional bounce angle 443 are held constant, bounce height 444 can be varied as a function of sole width 445, and vice versa.

As a general matter, bounce height (e.g., bounce height 444) can have more impact on how first club head 101 moves through turf than bounce angle (e.g., effective bounce angle 442 and/or traditional bounce angle 443). Increasing bounce height (e.g., bounce height 444) can cause first club head 101 to dig less into the turf while decreasing bounce height can cause first club head 101 to dig more into the turf. Accordingly, for softer ground conditions, it can be desirable to increase bounce height (e.g., bounce height 444), while for harder ground conditions, it can be desirable to decrease bounce height (e.g., bounce height 444). Advantageously, as indicated previously, bounce height 444 and/or sole width 445 of first club head 101 can be adjustable, such as, for example, according to the particular ground conditions before the round of golf begins or during the round of golf.

In some embodiments, loft angle 441 can be greater than or equal to approximately 15 degrees and less than or equal to approximately 65 degrees. In further embodiments, loft angle 441 can be greater than or equal to approximately 47 degrees and less than or equal to approximately 64 degrees, such as, for example, where first club head 101 comprises a wedge-type iron-type golf club head. In more specific examples, loft angle 441 can be one of approximately 56 degrees or approximately 60 degrees. Effective bounce angle 442 and/or traditional bounce angle 443 can be greater than or equal to approximately 0 degrees or less than or equal to approximately 20 degrees.

In some embodiments, bounce height 444 can be greater than or equal to approximately 0.500 centimeters or less than or equal to approximately 0.635 centimeters. Further, sole width 445 can be greater than or equal to approximately 0.6 centimeters or less than or equal to approximately 3.5 centimeters. The apparatus, methods, and articles of manufacture described herein are not limited in this regard.

In addition to varying bounce height 444 and/or sole width 445, first club head attachment members 109 can also vary by shape, density, weight, and/or mass distribution. By varying the density, weight, and/or mass distribution of first club head attachment member 109, the weight and mass distribution of first club head 101 can also be varied. In turn, a center of gravity of first club head 101 can be selectively varied, as desired, to selectively alter one or more moment of inertia parameters of first club head 101.

In these embodiments, first club head attachment members 109 can further comprise two or more first club head attachment members providing the same bounce height 444 and/or sole width 445 of first club head 101, but having different density, weight, and/or mass distribution configurations so that the location of the center of gravity of first club head 101 can be selectively varied. For example, first club head attachment members 109 can comprise a first set of two or more first club head attachment members (e.g., first club head first attachment member 129, first club head second attachment member 130, etc.) varying according to bounce height and/or sole width, and a second set of two or more first club head attachment members corresponding to the first set and having the approximately equal bounce heights and/or sole widths to the first set, but varying according to density, weight, and/or mass distribution configuration.

In many examples, first club head body 108 can comprise any suitable material(s), such as, for example, any suitable metal (e.g., aluminum, stainless steel, carbon steel, titanium, magnesium, etc.), any suitable non-metal (e.g., carbon fiber composite, polymer, fiber reinforced polymer, etc.), and/or any suitable alloys thereof. Further, first club head attachment members 109 can also comprise any suitable material(s), such as, for example, any suitable metal (e.g., aluminum, stainless steel, carbon steel, titanium, magnesium, lead, tungsten, gold, silver, etc.), any suitable non-metal (e.g., carbon fiber composite, polymer, fiber reinforced polymer, etc.), and/or any suitable alloys thereof. The first club head body 108 and first club head attachment members 109 can comprise the same or different materials. Further, each of first club head attachment members 109 can comprise the same or different materials. These materials can be varied appropriately to affect the density, weight, and/or mass distributions of first club head attachment members 109.

In other embodiments, first club head 101 can be configured such that loft angle 441 and one or more of effective bounce angle 442, traditional bounce angle 443, bounce height 444, and sole width 445 remain constant for first club head 101 as first club head body 108 is coupled with different ones of first club head attachment members 109. Meanwhile, in these or other embodiments, one or more of effective bounce angle 442, traditional bounce angle 443, bounce height 444, and sole width 445 can be varied for first club head 101 as first club head body 108 is coupled with different ones of first club head attachment members 109.

Figure 5:
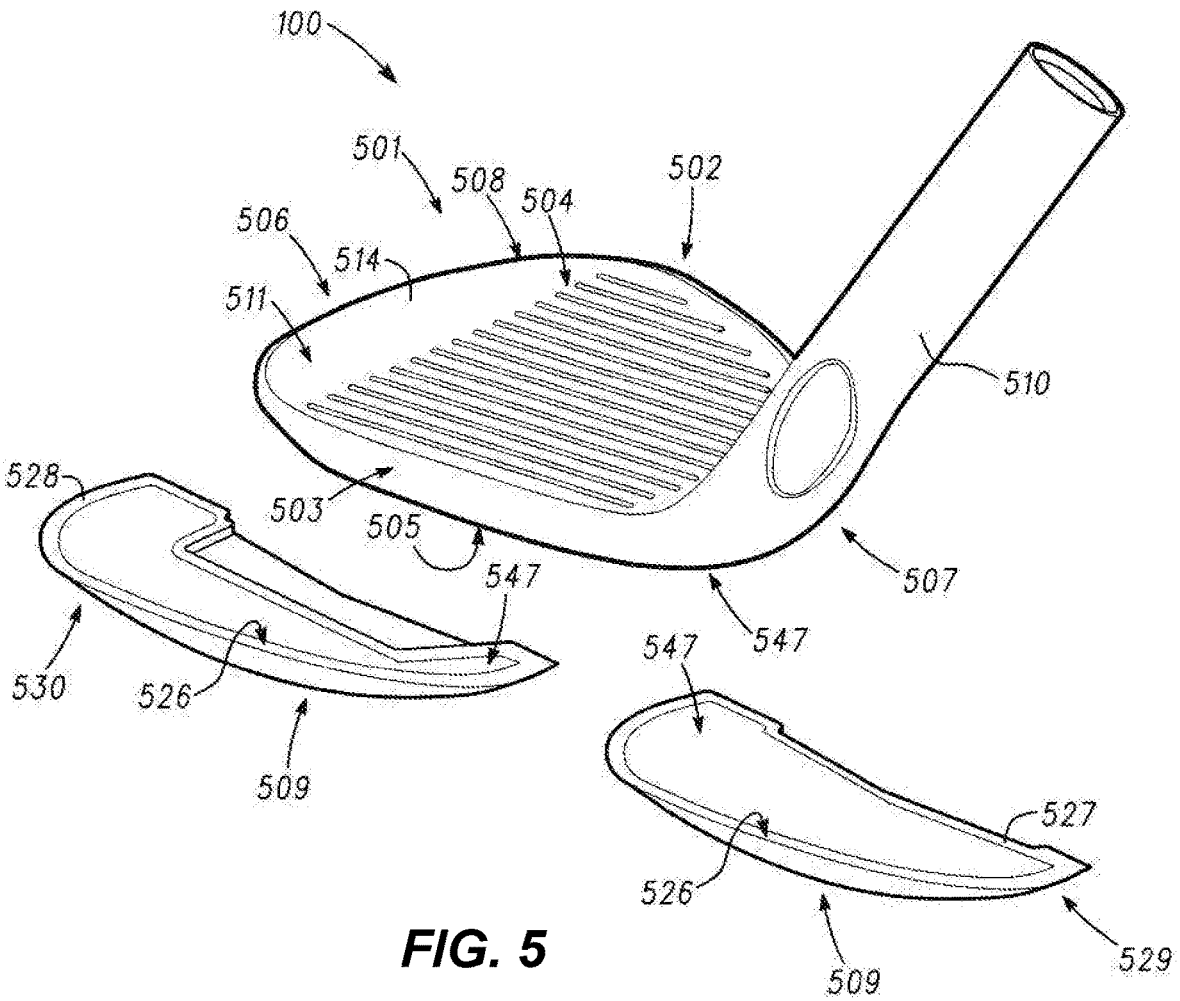
FIG. 5 illustrates a top, front, heel side view of a second club head body of a second club head next to two or more second club head attachment members, according to the embodiment of FIGS. 1, 2, & 4.
Figure 6:
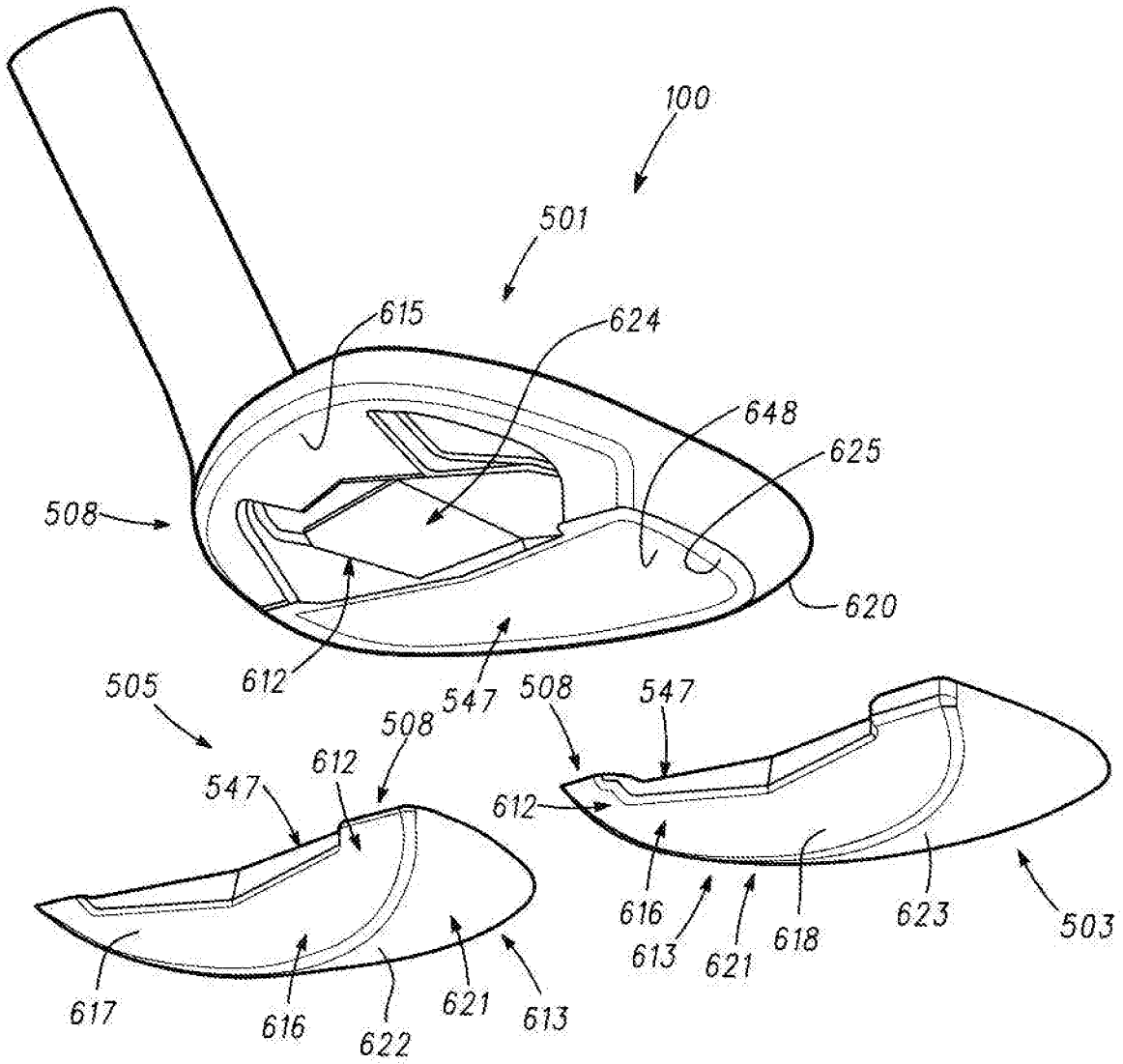
FIG. 6 illustrates a bottom, rear, toe side view of the second club head body of FIG. 5 next to two or more second club head attachment member(s), according to the embodiment of FIGS. 1, 2, 4, & 5.
Figure 7:
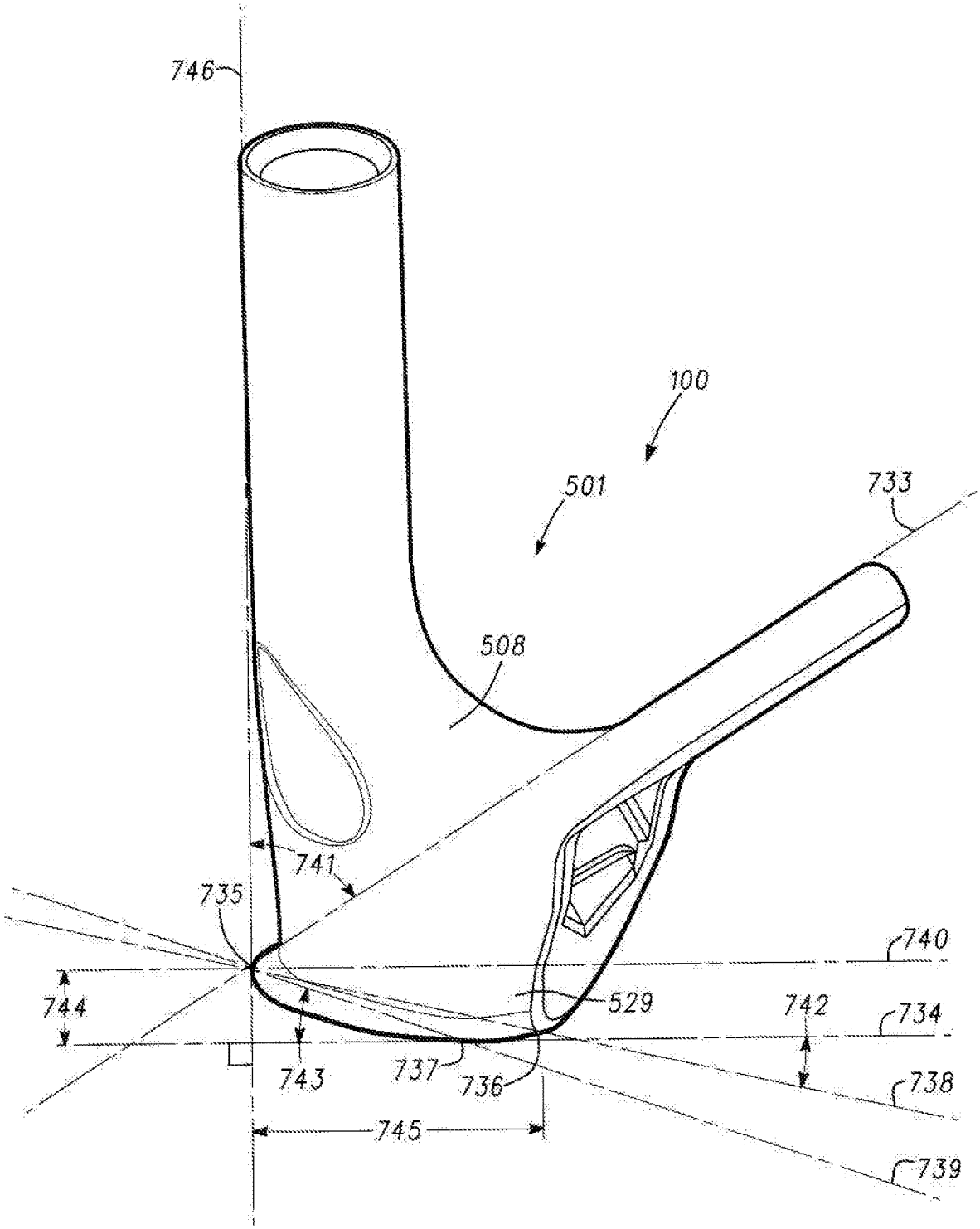
FIG. 7 illustrates a heel side view of the second club head of FIG. 5 when the second club head body is coupled to one of the second club head attachment members of the two or more second club head attachment members, according to the embodiment of FIGS. 1, 2, & 4-6.

Meanwhile, as indicated previously, in many embodiments, club head(s) 100 can also comprise one or more additional club heads, such as, for example, second club head 501 (FIGS. 5-7). FIG. 5 illustrates a top, front, heel side view of second club head body 508 of second club head 501 of club head(s) 100 next to second club head attachment members 509 of second club head 501, according to the embodiment of FIGS. 1, 2, & 4. Meanwhile, FIG. 6 illustrates a bottom, rear, toe side view of second club head body 508 of second club head 501 of club head(s) 100 next to second club head attachment member(s) 509, according to the embodiment of FIGS. 1, 2, 4, & 5. Further, FIG. 7 illustrates a bottom side view of second club head 501 when second club head body 508 is coupled to second club head attachment member 529, according to the embodiment of FIGS. 1, 2, & 4-6.

In general, second club head 501 can be similar or identical to first club head 101 (FIGS. 1, 2, & 4) and/or club head 301 (FIG. 3). For example, elements of first club head 101 and/or club head 301 and second club head 501 referenced with reference numbers having the same last two digits can be similar or identical to each other. However, second club head 501 can differ in that the loft angle of second club head 501 can be different than the loft angle of one or more other ones of club head(s) 100 (e.g., first club head 101 (FIGS. 1, 2, & 4)). For example, loft angle 441 (FIG. 4) can be less than or greater than loft angle 741 (FIG. 7). Accordingly, club head(s) 100 can each comprise a different loft angle (e.g., loft angle 441, loft angle 741, etc.). Meanwhile, in some examples, the bounce angle (e.g., effective bounce angles 442 and 742, and/or traditional bounce angles 443 and 743, etc.) can be less than, greater than, or equal from club head to club head within club head(s) 100. In further examples, the bounce height (e.g., bounce height 444 and bounce height 744, etc.) and/or sole width (e.g., sole width 445 and sole width 745, etc.) can be less than, greater than, or equal from club head to club head within club head(s) 100, but can also be variable depending on the club head attachment members (e.g., first club head attachment members 109, second club head attachment members 509, etc.) being used.

Further, in other embodiments, second club head 501 can be configured such that loft angle 741 and one or more of effective bounce angle 742, traditional bounce angle 743, bounce height 744, and sole width 745 remain constant for second club head 501 as second club head body 508 is coupled with different ones of second club head attachment members 509. Meanwhile, in these or other embodiments, one or more of effective bounce angle 742, traditional bounce angle 743, bounce height 744, and sole width 745 can be varied for second club head 501 as second club head body 508 is coupled with different ones of second club head attachment members 509.

Meanwhile, in some embodiments, the club head bodies (e.g., first club head body 108, second club head body 508, etc.) and/or club head attachment members (first club head attachment members 109, second club head attachment members 509, etc.) of each club head of club head(s) 100 can be configured to prevent club head attachment members of one club head (e.g., first club head 101) of club head(s) 100 from being coupled to another club head (e.g., second club head 501) of club head(s) 100.

Advantageously, club head(s) 100 can be implemented to provide the attributes of multiple fixed sole club heads in a single club head. Accordingly, a user of club head(s) 100 need not buy, maintain, and/or carry multiple fixed sole club heads of each loft angle.

Alternate Embodiment

In general, club head 901 is similar to first club head 101 (FIGS. 1, 2, & 4) and/or club head 301 (FIG. 3) and/or second club head 501 (FIG. 5). For example, elements of first club head 101, club head 301, and/or second club head 501 referenced with reference numbers having the same last two digits can be similar or identical to each other. However, club head 901 can differ in that the club head attachment member 929 is at least partially disposed within a recess 950 of club head body 908 of club head 901. (See FIG. 10).

Figure 9:
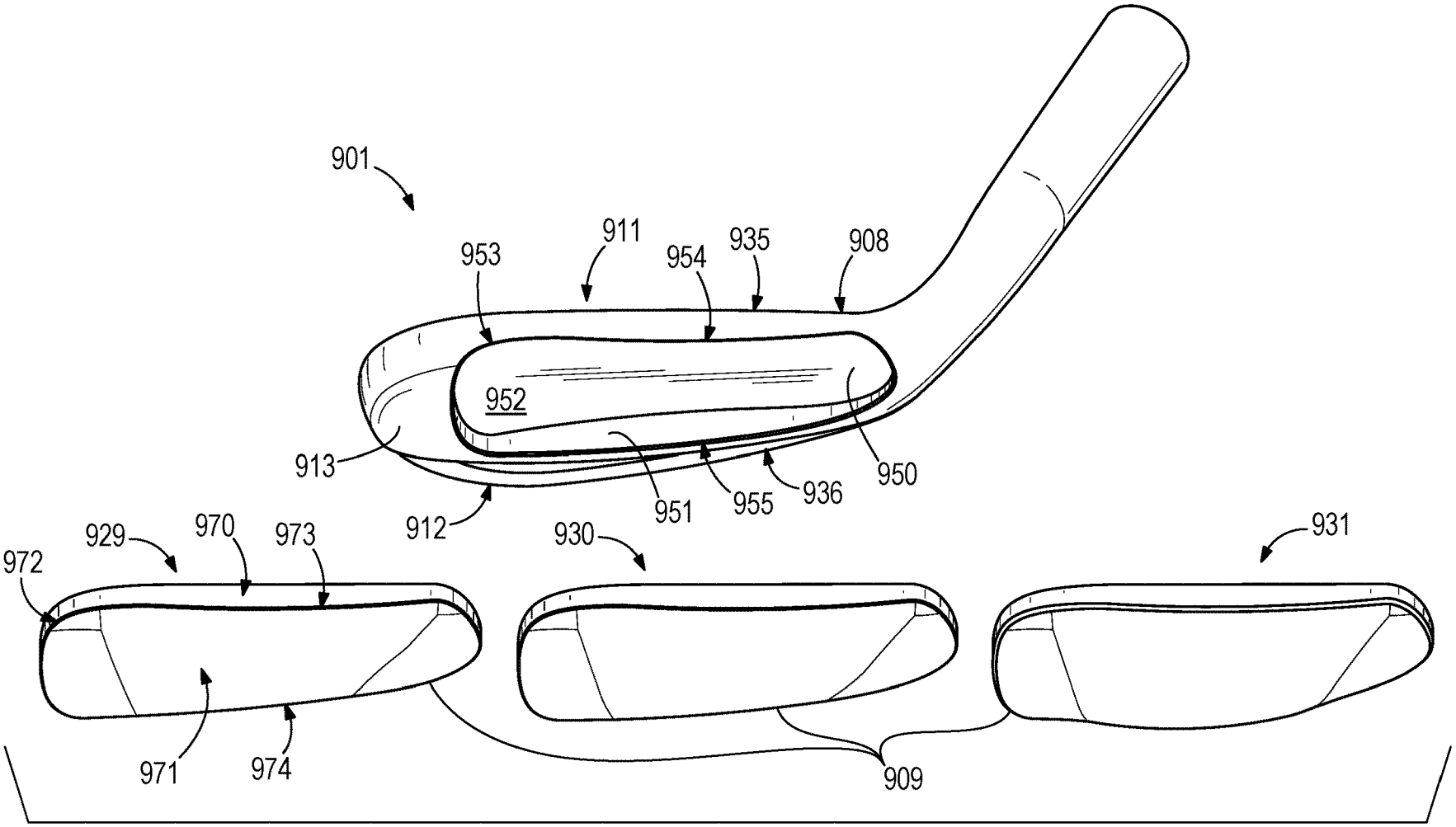
FIG. 9. illustrates a sole side view of a club head body of a club head next to three or more club head attachment members of the club head, according to an embodiment.

Turning to FIG. 9, the sole surface 913 of club head body 908 can include a recess 950. Accordingly, recess 950 can be entirely within the sole surface 913. Meanwhile, in some embodiments, recess 950 can be partially located at the sole surface 913 and partially located at one or more of the front surface 911 or rear surface 912. In some embodiments, recess 950 can comprise at least 40% of sole surface 913. In further embodiments, recess 950 can comprise at least 50% of sole surface 913. In more specific examples, recess 950 can comprise at least 60% of the sole surface 913.

The recess 950 can comprise a recess wall surface 951, a recess bottom surface 952, and a recess edge 953. Recess edge 953 can further comprise a recess front edge 954 and a recess rear edge 955. In some embodiments, recess front edge 954 can be coincident with leading edge 935 and/or recess rear edge 955 can be coincident with trailing edge 936. Meanwhile, in some embodiments, recess front edge 954 can be located at sole surface 913 and/or recess rear edge 955 can be located at sole surface 913.

In some embodiments, club head 901 comprises one of club head attachment members 909 (e.g., club head attachment member 929, 930, or 931) and club head body 908. In one example, club head attachment member 929 can comprise an attachment member insert portion 970 and an attachment member exterior portion 971. Club head attachment member 929 can be at least partially disposed within recess 950. For example, in some embodiments, attachment member insert portion 970 can be coincident with recess wall surface 951, but not recess bottom surface 952. In other embodiments, attachment member insert portion 970 can be coincident with recess wall surface 951 and recess bottom surface 952. In further embodiments, attachment member insert portion 970 of club head attachment member 929 may be entirely disposed within recess 950. In a more specific example, attachment member insert portion 970 has a depth that is similar or identical to the depth of recess 950.

Club head attachment member 929 can comprise an attachment member edge 972 where attachment member insert portion 970 meets attachment member exterior portion 971 and can further comprise an attachment member front edge 973 and an attachment member rear edge 974. In some embodiments, attachment member edge 972 is similar or identical to recess edge 953 such that, when club head attachment member 929 is disposed in recess 950, attachment member edge 972 is aligned with recess edge 953. Furthermore, in some embodiments, attachment member edge 972 and/or recess edge 953 are asymmetric, permitting only a single orientation of club head attachment member 929 when it is disposed in recess 950. In a more specific example, attachment member edge 972 and recess edge 953 can be aligned so that sole surface 913 and attachment member exterior portion are substantially continuous. In other embodiments, attachment member edge 972 and recess edge 953 can be separated by a gap.

Club head attachment members 909 can comprise various attachment members similar to club head attachment member 929 with varying characteristics. In some embodiments club head attachment members 909 can include club head attachment member 929, club head attachment member 930, or club head attachment member 931. For example, club head attachment member 929, club head attachment member 930, and club head attachment member 931 can comprise the same bounce angle, but different bounce heights and/or different bounce widths. In a more specific example, club head attachment members 929, 930, and 931 can comprise the same bounce angle, but club head attachment member 931 can have a larger bounce height than club head attachment member 930, which has a larger bounce height than club head attachment member 929.

Figure 10:
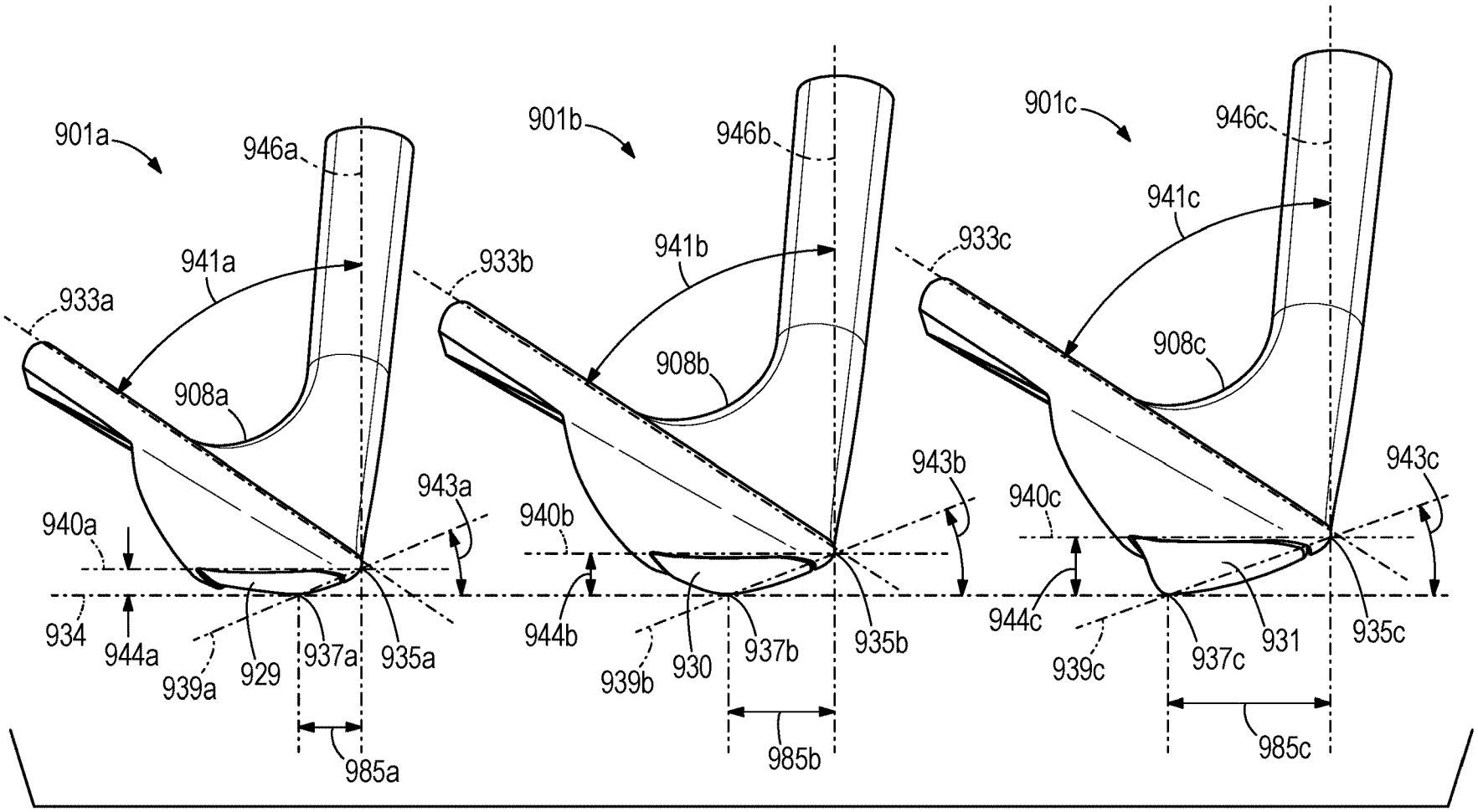
FIG. 10 illustrates a toe side view of the club head of FIG. 9 when the club head body is coupled to various of the three or more club head attachment members, according to the embodiment of FIG. 9.

As an illustrative example, FIG. 10 shows toe side views of club head 901 when club head body 908 is coupled to club head attachment member 929, club head attachment member 930, and club head attachment member 931 depicted as club head 901*a*, 901*b*, and 901*c* respectively.

Common to club head 901*a*, 901*b*, and 901*c*, club head 901 comprises loft plane 933 and ground plane 934. Further, club head 901 can also comprise leading edge 935, ground contact 937, contact line 939, and/or height plane 940. Loft plane 933, ground plane 934, contact plane 939, and height plane 940 can refer to reference planes of club head 901, and leading edge 935, trailing edge 936, and ground contact 937 can refer to reference points of club head 901. Meanwhile, club head 901 further comprises loft angle 941, traditional bounce angle 943, bounce height 944, and bounce width 985.

Loft plane 933 intersects the foremost point or points of front surface 911 (FIG. 9). In some examples, the foremost point can be leading edge 935. Further, loft plane 933 can be approximately parallel with front surface 911 (FIG. 9) when club head 901 is positioned both to address a golf ball and in a resting state. When front surface 911 (FIG. 9) is planar and/or substantially planar, front surface 911 and loft plane 933 can be approximately co-planar. Meanwhile, when front surface 911 (FIG. 9) is curved (e.g., non-planar), as can frequently be implemented with wood-type club heads, loft plane 933 can refer to a reference plane intersecting an inflection point in the curvature of front surface 911. Accordingly, in these embodiments, at least part of front surface 911 (FIG. 9) can be located behind loft plane 933.

Similar to other embodiments above, leading edge 935 can refer to a foremost point of sole surface 913 (FIG. 9) when club head 901 is positioned both to address a golf ball and in a resting state; and ground contact 937 can refer to a lowest point of sole surface 913 (FIG. 9) when first club head 901 is positioned both to address a golf ball and in a resting state.

Similar to other embodiments above, ground plane 934 refers to the plane generally formed by the ground below club head 901 when club head 901 is positioned to address a golf ball. Ground plane 934 can intersect ground contact 937 when club head 901 is positioned to address a golf ball. Meanwhile, contact line 939 refers to the line intersecting leading edge 935 and ground contact 937. Further, height plane 940 refers to a plane approximately parallel to ground plane 934 and intersecting leading edge 935.

Similar to other embodiments above, bounce height 944 can refer to a distance between ground plane 934 and height plane 940. Meanwhile, bounce width 985 can refer to a distance between leading edge 935 and ground contact 937.

Similar to other embodiments above, loft angle 941 can refer to an angle formed between loft plane 933 and normal line 946, which refers to a reference line orthogonal to ground plane 934 and intersecting leading edge 935 when first club head 901 is positioned to address a golf ball. Traditional bounce angle 943 can refer to an angle formed between contact line 939 and ground plane 934.

Similar to other embodiments above, club head 901 can be configured such that loft angle 941, traditional bounce angle 943 remain constant for club head 901 while bounce height 944 and/or bounce width 985 can be varied for club head 901 as club head body 908 is coupled with different ones of club head attachment members 909. As a result, bounce height 944 and/or bounce width 985 can be tailored as desired for first club head 901. That is, first club head 901 can be adjustable so that coupling different ones of first club head attachment members 909 to first club head body 908 can provide differing configurations of bounce height 944 and/or bounce width 985. Further, when traditional bounce angle 943 is held constant, bounce height 944 can be varied as a function of bounce width 985, and vice versa.

As an example, FIG. 10 depicts club head 901 configured so that loft angle 941 and traditional bounce angle 943 are constant (941*a*, 941*b*, and 941*c* are equal to one another and 943*a*, 943*b*, and 943*c* are equal to one another). In that example, bounce height 944 and bounce width 985 vary as club head body 908 is coupled with different club head attachment members 909. In the example illustrated by FIG. 10, bounce height 944*a* is smaller than bounce height 944*b*, which is smaller than bounce height 944*c*. Furthermore, in the example illustrated by FIG. 10, bounce width 985*a* is smaller than bounce width 985*b*, which is smaller than bounce width 985*c*.

In some embodiments, one of the club head attachment members 909 will be a standard shape and size (i.e. club head attachment member 930) so that club head 901 has substantially the same size and shape as a similar club head with no recess or attachment members (i.e. club head 901*b*). Furthermore, club head attachment members 909 can comprise one or more club head attachment members with smaller bounce heights and bounce widths (i.e. club head attachment member 929) to increase how much the club head digs into the turf for use on harder ground conditions (i.e. club head 901*a*). Club head attachment members 909 can also comprise one or more club head attachment members with larger bounce heights and widths (i.e. club head attachment member 931) to decrease how much the club head digs into the turf for use on softer ground conditions (i.e. club head 901*c*). Advantageously, as indicated previously, bounce height 944 and/or bounce width 945 of club head 901 can be adjustable, such as, for example, according to the particular ground conditions before the round of golf begins or during the round of golf.

In some embodiments, loft angle 941 can be greater than or equal to approximately 15 degrees and less than or equal to approximately 65 degrees. In further embodiments, loft angle 441 can be greater than or equal to approximately 47 degrees and less than or equal to approximately 64 degrees, such as, for example, where club head 901 comprises a wedge-type iron-type golf club head. In more specific examples, loft angle 941 can be one of approximately 56 degrees or approximately 60 degrees. Traditional bounce angle 943 can be greater than or equal to approximately 0 degrees or less than or equal to approximately 20 degrees.

In addition to varying bounce height 944 and/or bounce width 985, club head attachment members 909 can also vary by shape, density, weight, and/or mass distribution. By varying the density, weight, and/or mass distribution of club head attachment member 909, the weight and mass distribution of club head 901 can also be varied. In turn, a center of gravity of club head 901 can be selectively varied, as desired, to selectively alter one or more moment of inertia parameters of club head 901.

In these embodiments, club head attachment members 909 can further comprise two or more club head attachment members providing the same bounce height 944 and/or bounce width 985 of club head 901, but having different density, weight, and/or mass distribution configurations so that the location of the center of gravity of club head 901 can be selectively varied. For example, club head attachment members 909 can comprise a set of two or more club head attachment members (e.g., club head attachment member 929, club head attachment member 930, etc.) varying according to bounce height and/or sole width, and a second set of two or more club head attachment members corresponding to the set and having the approximately equal bounce heights and/or sole widths to the first set, but varying according to density, weight, and/or mass distribution configuration.

In other embodiments, club head 901 can be configured such that loft angle 941 and one or more of traditional bounce angle 943, bounce height 944, and bounce width 985 remain constant for club head 901 as club head body 908 is coupled with different ones of club head attachment members 909. Meanwhile, in these or other embodiments, one or more of traditional bounce angle 943, bounce height 944, and bounce width 985 can be varied for club head 901 as club head body 908 is coupled with different ones of club head attachment members 909.

Figure 11:
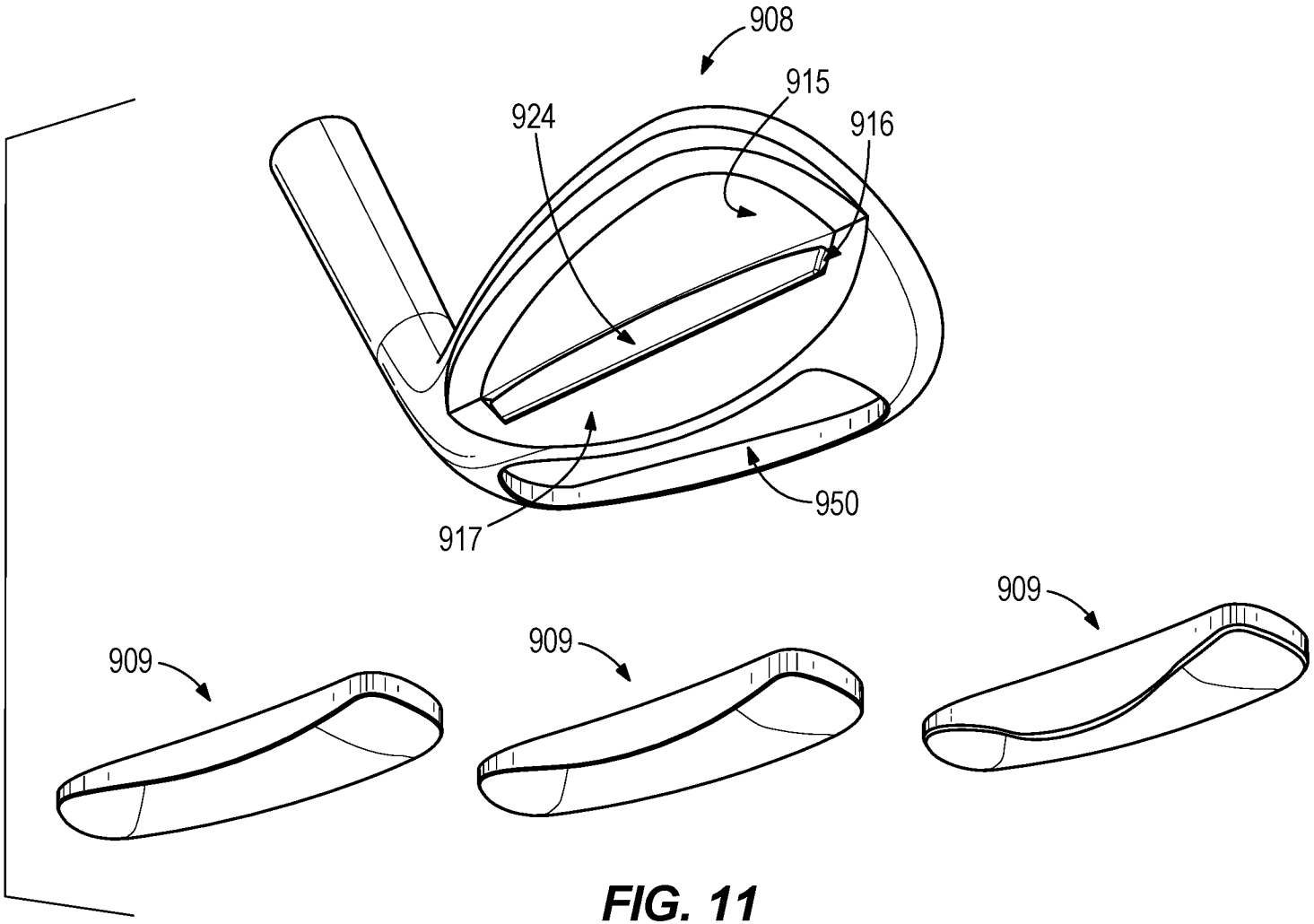
FIG. 11 illustrates a bottom, rear, toe side view of the club head of FIG. 9 when the club head body is coupled to a CTP weight.

Turning to FIG. 11, in some embodiments, body rear surface 915 of club head body 908 can comprise a back cavity 916 comprising a custom tuning port (CTP). A CTP weight 924 can be disposed in back cavity 916. Body rear surface 915 can comprise a back flange 917 adjacent to back cavity 916. In some embodiments body rear surface 915 is separate from recess 950. In further embodiments the back flange 917 and/or back cavity 916 is separate from recess 950. In more specific examples, CTP weight 924 is separate from recess 950 and/or club head attachment members 909. In alternate embodiments, recess 950 can be partially located on back surface 915. In further embodiments, all or part of back cavity 916 and/or back flange 917 can be located on club head attachment members 909. In some examples, CTP weight 924 can be entirely or partially coupled with club head attachment members 909. CTP weight 924 can therefore be removable from club head body 908 with club head attachment members 909. In other embodiments, club head attachment members 909 can be removed from or attached to club head body 908 without removing CTP weight 924. Thus, club head 901 can have the advantages of CTP weight 924 without requiring a separate CTP weight 924 for each of club head attachment members 909.

Figure 8:
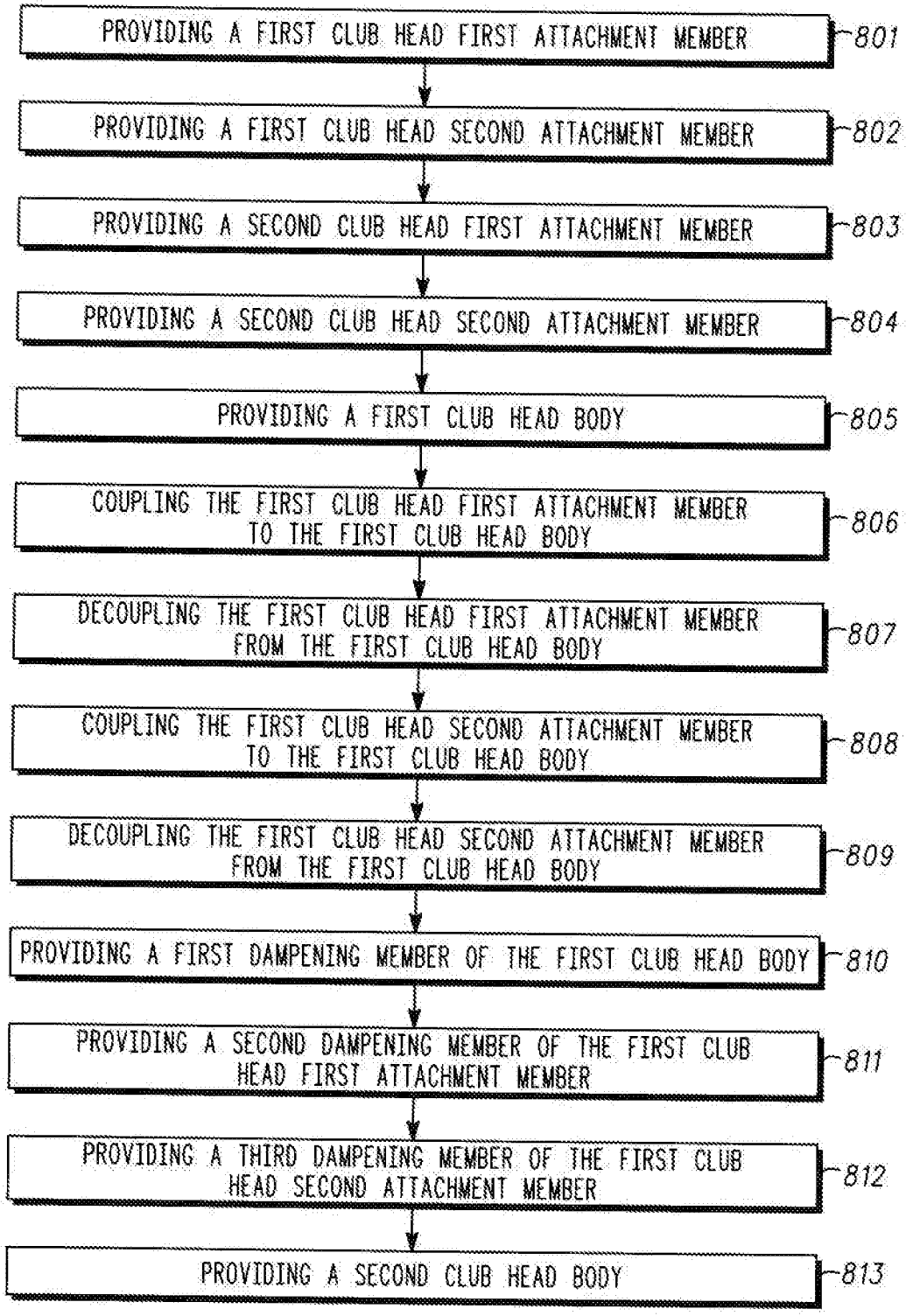
FIG. 8 illustrates a flow chart for an embodiment of a method.

FIG. 8 illustrates a flow chart for an embodiment of method 800. Method 800 is merely exemplary and is not limited to the embodiments presented herein. Method 800 can be employed in many different embodiments or examples not specifically depicted or described herein. In some embodiments, the activities, the procedures, and/or the processes of method 800 can be performed in the order presented. In other embodiments, the activities, the procedures, and/or the processes of method 800 can be performed in any other suitable order. In still other embodiments, one or more of the activities, the procedures, and/or the processes in method 800 can be combined or skipped.

Method 800 can comprise activity 801 of providing a first club head first attachment member. The first club head first attachment member can be similar or identical to one of first club head attachment members 109 (e.g., first club head first attachment member 129 (FIGS. 1, 2, & 4)) and/or club head attachment members 309 (FIG. 3). In some embodiments, performing activity 801 can comprise an activity of providing the first club head first attachment member so that the first club head first attachment member comprises a first weight. In further embodiments, performing activity 801 can comprise an activity of configuring a first bounce height of the first club head first attachment member to be greater than or equal to approximately 0.500 centimeters or less than or equal to approximately 0.635 centimeters; and/or an activity of configuring a first sole width to be greater than or equal to approximately 0.6 centimeters or less than or equal to approximately 3.5 centimeters.

Method 800 also can comprise activity 802 of providing a first club head second attachment member. The first club head second attachment member can be similar or identical to another one of first club head attachment members 109 (e.g., first club head second attachment member 130 (FIGS. 1, 2, & 4)). In some embodiments, performing activity 802 can comprise an activity of providing the first club head second attachment member so that the first club head second attachment member comprises a second weight different than the first weight.

In some embodiments, performing activities 801 and 802 can comprise (i) an activity of configuring a first loft angle to be greater than or equal to approximately 47 degrees and less than or equal to approximately 64 degrees; and/or (ii) an activity of configuring a first bounce angle to be greater than or equal to approximately 0 degrees or less than or equal to approximately 20 degrees.

Method 800 can further comprise activity 803 of providing a second club head first attachment member. The second club head first attachment member can be similar or identical to one of second club head attachment members 509 (e.g., second club head first attachment member 529 (FIGS. 5-7)).

Method 800 can still further comprise activity 804 of providing a second club head second attachment member. The second club head second attachment member can be similar or identical to another one of second club head attachment members 509 (e.g., second club head second attachment member 530 (FIGS. 5-7)).

Method 800 can additionally comprise activity 805 of providing a first club head body. The first club head body can be similar or identical to first club head body 108 (FIGS. 1, 2, & 4) and/or club head body 308 (FIG. 3).

Method 800 also can comprise activity 806 of coupling the first club head first attachment member to the first club head body. In some embodiments, performing activity 806 can comprise using a first alignment aid to couple the first club head first attachment member to the first club head body.

Method 800 can further comprise activity 807 of decoupling the first club head first attachment member from the first club head body. In some embodiments, one or both of activities 806 and 807 can be omitted.

Method 800 can still further comprise activity 808 of coupling the first club head second attachment member to the first club head body. In some embodiments, performing activity 808 can comprise using a first alignment aid to couple the first club head second attachment member to the first club head body.

Method 800 can additionally comprise activity 809 of decoupling the first club head second attachment member from the first club head body. In some embodiments, one or both of activities 808 and 809 can be omitted.

Method 800 also can comprise: activity 810 of providing a first dampening member of the first club head body; activity 811 of providing a second dampening member of the first club head first attachment member; and/or activity 812 of providing a third dampening member of the first club head second attachment member. The first dampening member can be similar or identical to dampening member 248 (FIG. 2), the second dampening member can be similar or identical to dampening member 149 (FIG. 1), and/or the third dampening member can be similar or identical to dampening member 150 (FIG. 1). In some embodiments, activities 810, 811, and/or 812 can be omitted.

Method 800 also can comprise activity 813 of providing a second club head body. The second club head body can be similar or identical to second club head body 508 (FIGS. 5-7).

Turning to the drawings, FIG. 1 illustrates a top, front, heel side view of a first club head body 108 of a first club head 101 of one or more club heads 100 next to two or more first club head attachment members 109 of first club head 101

Although the golf club head(s), attachment members, and related methods herein have been described with reference to specific embodiments, various changes may be made without departing from the spirit or scope of the present disclosure. For example, to one of ordinary skill in the art, it will be readily apparent that activities 801-813 of FIG. 8 may be comprised of many different procedures, processes, and activities and be performed by many different modules, in many different orders, that any element of FIGS. 1-8 may be modified, and that the foregoing discussion of certain of these embodiments does not necessarily represent a complete description of all possible embodiments.

Further, while the above examples may be described in connection with an iron-type golf club head, the apparatus, methods, and articles of manufacture described herein may be applicable to other types of golf clubs such as a wood-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and are not intended to be limiting. It is intended that the scope of this application shall be limited only to the extent required by the appended claims.

The golf club head(s), attachment members, and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:

a partial club head body configured to be removably coupled at different times with a first attachment member and a second attachment member in a recess of the club head body;

a back cavity separate from the recess;

a custom tuning port weight comprising a top end;

wherein the partial club head body further comprises a front surface, a top portion, a toe portion, a heel portion, and a sole portion;

wherein the partial club head body sole portion is omitted when neither the first nor the second attachment are removably coupled within the recess of the partial club head body;

wherein the back cavity comprises a top and a bottom;

wherein a complete club head body is formed when the first or the second attachment member is coupled with the partial club head body to form a sole portion;

wherein the first or the second attachment member comprises all of the sole portion extending entirely from the toe portion to the heel portion of the complete club head body;

wherein:

when the partial club head body is coupled with the first attachment member, the complete club head body comprises:

a first sole portion;

a loft angle;

a bounce angle; and a first bounce height;

and when the partial club head body is coupled with the second attachment member, the complete club head body comprises:

a second sole portion;

the loft angle;

the bounce angle; and a second bounce height different than the first bounce height;

wherein the back cavity has an opening at the top of the back cavity and is closed at the bottom of the back cavity;

wherein the first attachment member comprises an asymmetric edge;

wherein the second attachment member comprises an asymmetric edge;

wherein the custom tuning port weight is disposed in the back cavity such that the top of the custom tuning port weight is exposed, and the custom tuning port weight is separate from the recess;

wherein the recess comprises a recess edge;

wherein the recess edge is asymmetric in relation to the asymmetric edge of either the first attachment member or the second attachment member;

wherein the first attachment member or the second attachment member is disposed in the recess in a single orientation;

wherein the first attachment member comprises a first density and the second attachment member comprises a second density different than the first density.

2. The golf club head of claim 1 wherein:

when the partial club head body is coupled with the first attachment member, the complete club head comprises:

a first bounce width;

and when the partial club head body is coupled with the second attachment member, the complete club head comprises:

a second bounce width different than the first bounce width;

wherein the first or second bounce width is measured from a front of the bounce to a rear of the bounce.

3. The golf club head of claim 1 wherein:

the first attachment member comprises a first weight and the second attachment member comprises a second weight different than the first weight.

4. The golf club head of claim 1 wherein:

the first attachment member comprises a first shape and the second attachment member comprises a second shape different than the first shape.

5. The golf club head of claim 1 wherein:

the first attachment member comprises a first mass distribution and the second attachment member comprises a second mass distribution different than the first mass distribution.

6. The golf club head of claim 1 wherein:

the club head body comprises a first material and the first attachment member and second attachment member comprise the first material.

7. The golf club head of claim 1 wherein:

the club head body comprises a first material and the first attachment member and second attachment member both comprise a second material different from the first material.

8. The golf club head of claim 1 wherein:

the partial club head body comprises a body alignment aid configured to facilitate coupling the partial club head body to the first attachment member or the second attachment member.

9. The golf club head of claim 1 wherein:

the bounce angle is greater than or equal to approximately 0 degrees, or less than or equal to approximately 20 degrees.

10. The golf club head of claim 1 wherein:

the first bounce height is greater than or equal to approximately 0.500 centimeters or less than or equal to approximately 0.635 centimeters.

11. A golf club head comprising:

a partial club head body configured to be removably coupled at different times with a first attachment member and a second attachment member in a recess of the club head body;

a back cavity separate from the recess;

a custom tuning port weight comprising a top end;

wherein the partial club head body further comprises a front surface, a top portion, a toe portion, a heel portion, and a sole portion;

wherein the partial club head body sole portion is omitted when neither the first nor the second attachment are removably coupled within the recess of the partial club head body;

wherein the back cavity comprises a top and a bottom;

wherein a complete club head body is formed when the first or the second attachment member is coupled with the partial club head body to form a sole portion;

wherein the first or the second attachment member comprises all of the sole portion extending entirely from the toe portion to the heel portion of the complete club head body;

wherein:

when the partial club head body is coupled with the first attachment member, the complete club head body comprises:

a first sole portion having a first sole width;

a loft angle;

a bounce angle; and a first bounce height;

and when the partial club head body is coupled with the second attachment member, the complete club head body comprises:

a second sole portion having a second sole width;

the loft angle;

the bounce angle; and a second bounce height different than the first bounce height;

wherein the back cavity has an opening at the top of the back cavity and is closed at the bottom of the back cavity;

wherein the first attachment member comprises an asymmetric edge;

wherein the second attachment member comprises an asymmetric edge;

wherein the custom tuning port weight is disposed in the back cavity such that the top of the custom tuning port weight is exposed, and the custom tuning port weight is separate from the recess;

wherein the recess comprises a recess edge;

wherein the recess edge is asymmetric in relation to the asymmetric edge of either the first attachment member or the second attachment member;

wherein the first attachment member or the second attachment member is disposed in the recess in a single orientation;

wherein the first sole width is different than the second sole width.

12. The golf club head of claim 11 wherein:

when the partial club head body is coupled with the first attachment member, the complete club head comprises:

a first bounce width;

and when the partial club head body is coupled with the second attachment member, the complete club head comprises:

a second bounce width different than the first bounce width;

wherein the first or second bounce width is measured from a front of the bounce to a rear of the bounce.

13. The golf club head of claim 11 wherein:

the first attachment member comprises a first weight and the second attachment member comprises a second weight different than the first weight.

14. The golf club head of claim 11 wherein:

the first attachment member comprises a first shape and the second attachment member comprises a second shape different than the first shape.

15. The golf club head of claim 11 wherein:

the first attachment member comprises a first mass distribution and the second attachment member comprises a second mass distribution different than the first mass distribution.

16. The golf club head of claim 11 wherein:

the club head body comprises a first material and the first attachment member and second attachment member both comprise a second material different from the first material.

17. The golf club head of claim 11 wherein:

the partial club head body comprises a body alignment aid configured to facilitate coupling the partial club head body to the first attachment member or the second attachment member.

18. The golf club head of claim 11 wherein:

the bounce angle is greater than or equal to approximately 0 degrees, or less than or equal to approximately 20 degrees.

19. The golf club head of claim 11 wherein:

the first bounce height or the second bounce height is greater than or equal to approximately 0.500 centimeters, or less than or equal to approximately 0.635 centimeters.

20. The golf club head of claim 11 wherein:

The first sole width or the second sole width is greater than or equal to approximately 0.6 centimeters or less than, or less than or equal to approximately 3.5 centimeters.

* * * * *